US005131492A

United States Patent [19]

Caminiti et al.

[11] Patent Number: 5,131,492

[45] Date of Patent: Jul. 21, 1992

[54] PORTABLE LIGHTWEIGHT COLLAPSIBLE FOOTSTOOL WITH MEANS FOR DETACHABLY MOUNTABLE

[76] Inventors: Anthony D. Caminiti; Judith A. Caminiti, both of 6909 N. Brevard Ave., Tampa, Fla. 33604-4748

[21] Appl. No.: 664,835

[22] Filed: Mar. 5, 1991

[51] Int. Cl.[5] ..... A47C 9/00

[52] U.S. Cl. ..... 182/77; 182/91; 182/96; 182/156

[58] Field of Search ..... 182/77, 81, 35, 96, 182/156, 91

[56] References Cited

U.S. PATENT DOCUMENTS

| | | | |
|---|---|---|---|
| 2,581,488 | 1/1952 | Keltner | 182/77 |
| 2,743,861 | 5/1956 | Mattis | 182/77 |
| 3,030,166 | 4/1962 | Richards | 182/96 |
| 3,136,386 | 6/1964 | Horvath | 182/96 |
| 4,720,116 | 1/1988 | Williams | 182/96 |

*Primary Examiner*—Reinaldo P. Machado

[57] ABSTRACT

A collapsible folding step-stool which is mountable to a cabinet door. The step stool comprises (1) a bracket mountable to the cabinet door; (2) a platform movable between a lowered, generally horizontal, operative position and a raised, generally vertical, inoperative position; (3) a plurality of parallel arms attached at their first ends to the platform and pivotally coupled at their second ends to the bracket; and (4) a plurality of parallel support legs movable between a generally vertical operative position perpendicular to the platform and a generally vertical inoperative position parallel with the platform and the bracket. The support legs have upper ends pivotally coupled to the platform and lower ends which, when the platform is in the operative position, are adapted to rest on the floor with the lower ends of the legs at a lower elevation than the bottom of the bracket.

7 Claims, 4 Drawing Sheets

PORTABLE LIGHTWEIGHT COLLAPSIBLE FOOTSTOOL WITH MEANS FOR DETACHABLY MOUNTABLE

BACKGROUND OF THE INVENTION

1. Summary of the Invention

This invention pertains to portable, lightweight, compact, collapsible self-supporting stools which may be detachably mountable within a cabinet door or onto any mobile or immobile vertical, slanted or horizontal surface for convenient storability.

2. Description of the Background Art

From the time the first man stepped upon a rock to grasp something beyond his normal reach, to the present time, innumerable devices, step-stools, ladders, scaffolds and the like have been fashioned to allow a person to obtain access to objects out of range of one's normal stature. These include folding ladders, step-stools and combinations of step-stools with seats. Over a period of time, many of these devices have become very sophisticated, some with specifice uses in mind, and others with more general applications. In the case of this invention, there is a somewhat specific purpose for its use.

Throughout the world, there are many short people, particularly women and children, the women being the most consistent users of kitchens for food preparation therein. The typical American kitchen contains base cabinets that are approximately three feet high and two feet deep, with storage below, of course, and usually equipped with a plurality of doors and drawers. Above these base cabinets, mounted upon the wall beyond, are wall cabinets, which range in height from two and a half feet to three and a half feet, being mounted approximately sisteen to eighteen inches above the base cabinets. There are other heights of wall cabinets over stoves, refrigerators, pass-throughs and the like, to be sure, but these are the average wall cabinet heights, also depending upon whether or not they reach the full eight foot normal ceiling height or a seven foot soffit or dropped illuminated ceiling.

In any event, this places one or more intermediate shelves of the wall cabinets out of the reach of the average short person without the aid of some sort of stool or ladder. Not all kitchens have pantries or broom closets in which to store such a ladder or step-stool, and when they do, they are still usually unwieldly and usually obstruct access to whatever items are stored therein.

The present invention provides a rise of 9½ to 10 inches and is designed to fold compactly to a depth of approximately 2½ to 3 inches and is detachably mounted upon the inside surface of a base cabinet door so that when the door is closed, the stool is stored within the base cabinet without interfering with the contents within the cabinet. In order to use this step-stool, a person only has to open the cabinet door, swing down the folding step-stool, locking it in a stabilized position, which then provides the user with a self-supporting riser which is not dependent upon the cabinet door, its screws or hinges in order to support the weight of the user. In fact, the unique design of this invention and its integral mounting bracket allows the user to detachably mount the device so that it can be removed and used about the rest of the kitchen or other areas as an independent step-stool.

However, in its mounted configuration, as depicted in the drawings, depending upon whether the door is swung to a ninety degree relationship to the base cabinet or a one hundred eighty degree relationship, the stool can be made accessible to up to four adjacent wall cabinets without being removed from the cabinet door.

SUMMARY OF THE INVENTION

The invention is defined by the appended claims with the specific embodiments shown in the attached drawings. For the purpose of summarizing the invention, the invention may be incorporated into an improved apparatus for compact storability of a lightweight, collapsible, portable self-supporting step-stool which can be detachably mounted upon a cabinet door or upon any mobile or immobile vertical, slanted or horizontal surface.

The foregoing has outlined rather broadly the more pertinent and important features of the invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should be realized by those skilled in the art that such equivalent constructions do not depart from the spirit and scope of the invention as set forth in the appended claims.

DESCRIPTION OF THE DRAWINGS

For a fuller understanding of the nature and object of the present invention, reference should be had to the following detailed description taken in conjunction with the accompanying drawings, in which.

Figure 1:
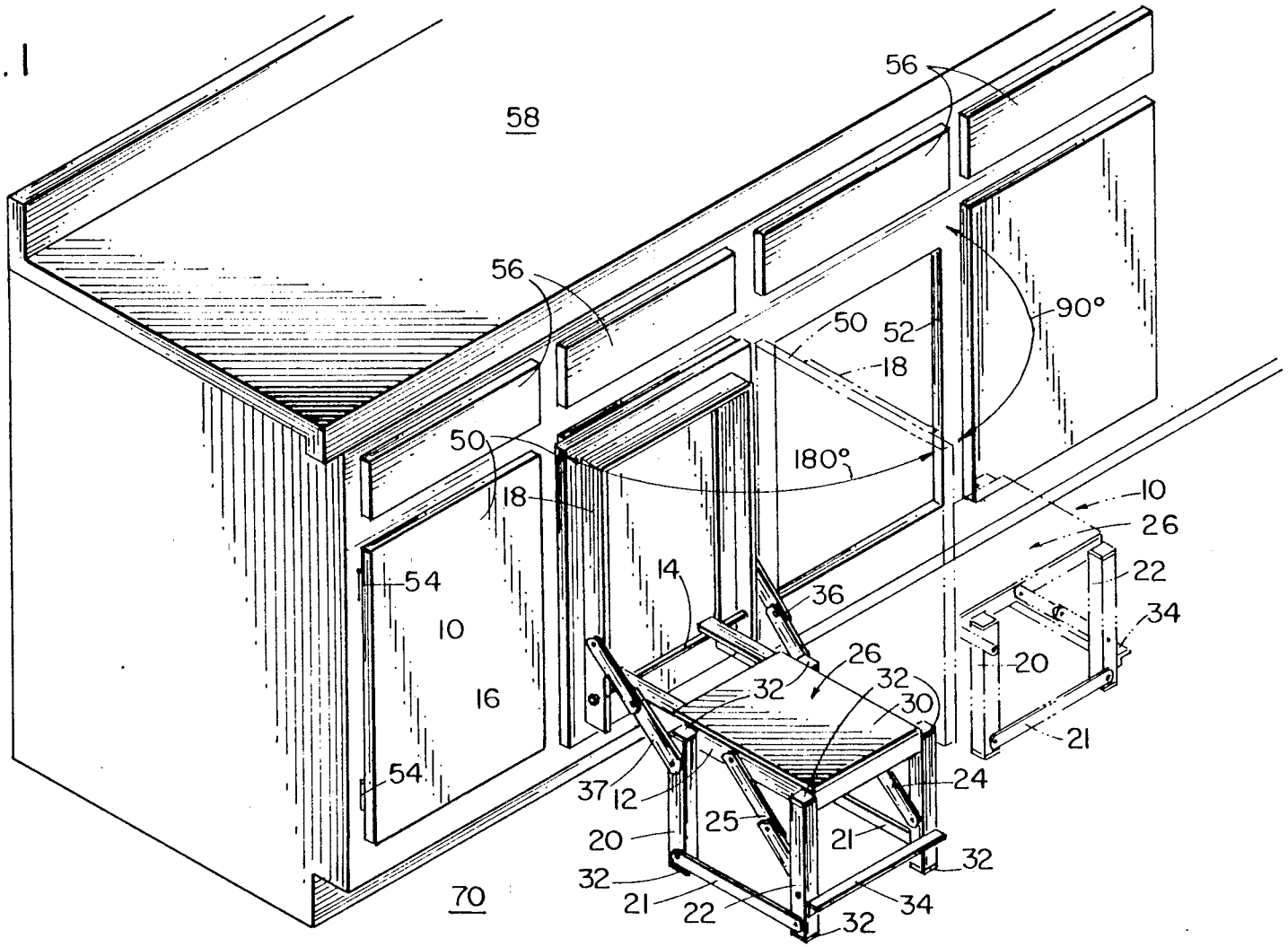
FIG. 1 is a perspective view of the invention mounted upon one of a series of side-by-side cabinet doors, shown in solid lines in the 180° position and shown in phantom lines in the 90° position, and, FIG. 2 is a front elevational view of the invention in its extended configuration, as mounted upon a cabinet door, and, FIG. 3 is a side elevational view of the invention in its extended configuration, as mounted upon a cabinet door, and, FIG. 4 is a front elevational view of the invention in its retracted configuration, as mounted upon a cabinet door, and, FIG. 5 is a side elevational view of the invention in its retracted configuration, as mounted upon a cabinet door, and, FIG. 6 is a fragmented elevational view of an alternate means of detachably mounting of the invention upon a cabinet door, and, FIG. 7 is a fragmented section taken along the lines 7—7 of FIG. 6, showing the alternate means of detachably mounting of the invention upon a cabinet door.
Figure 2:
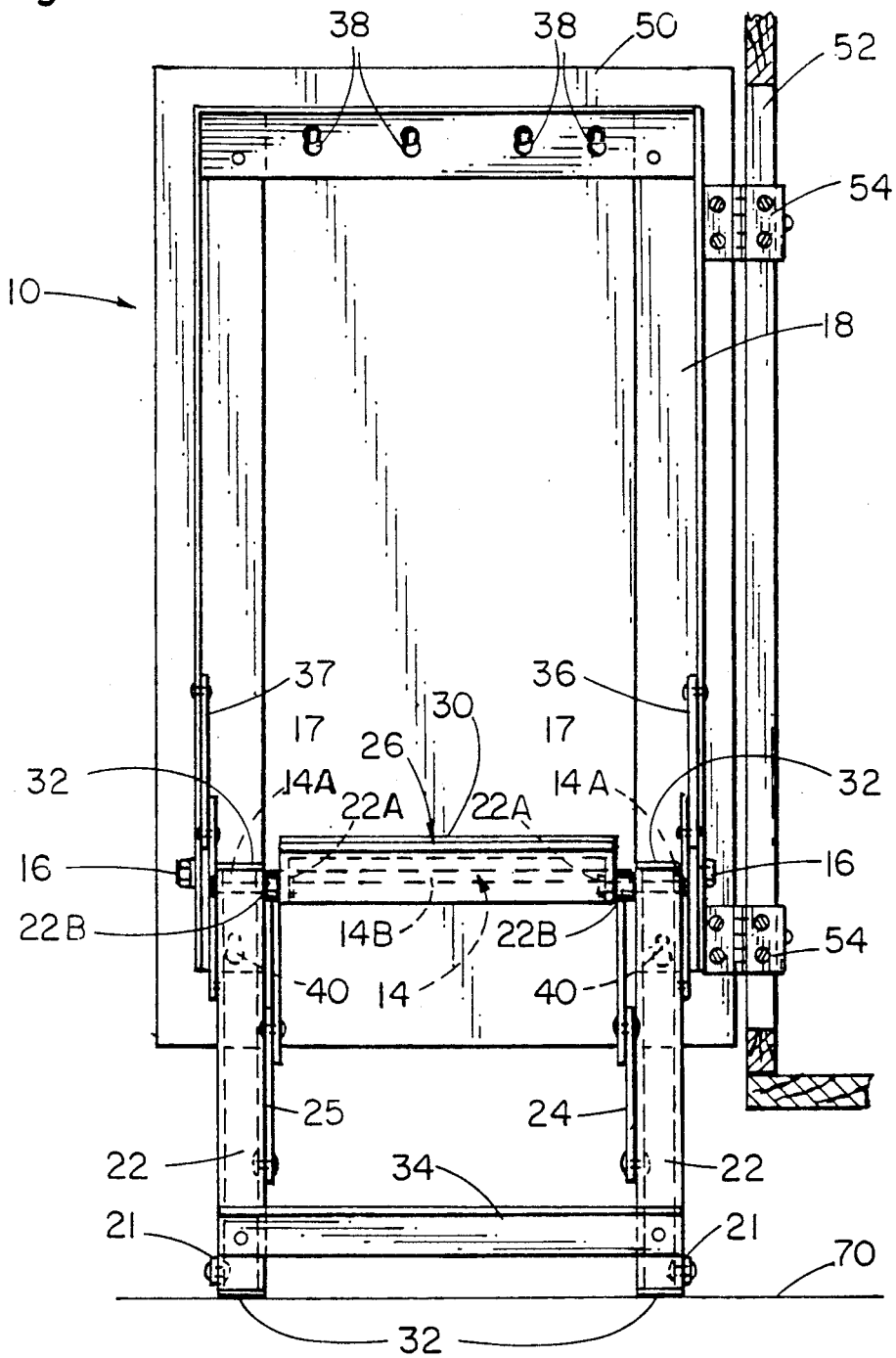
Figure 3:
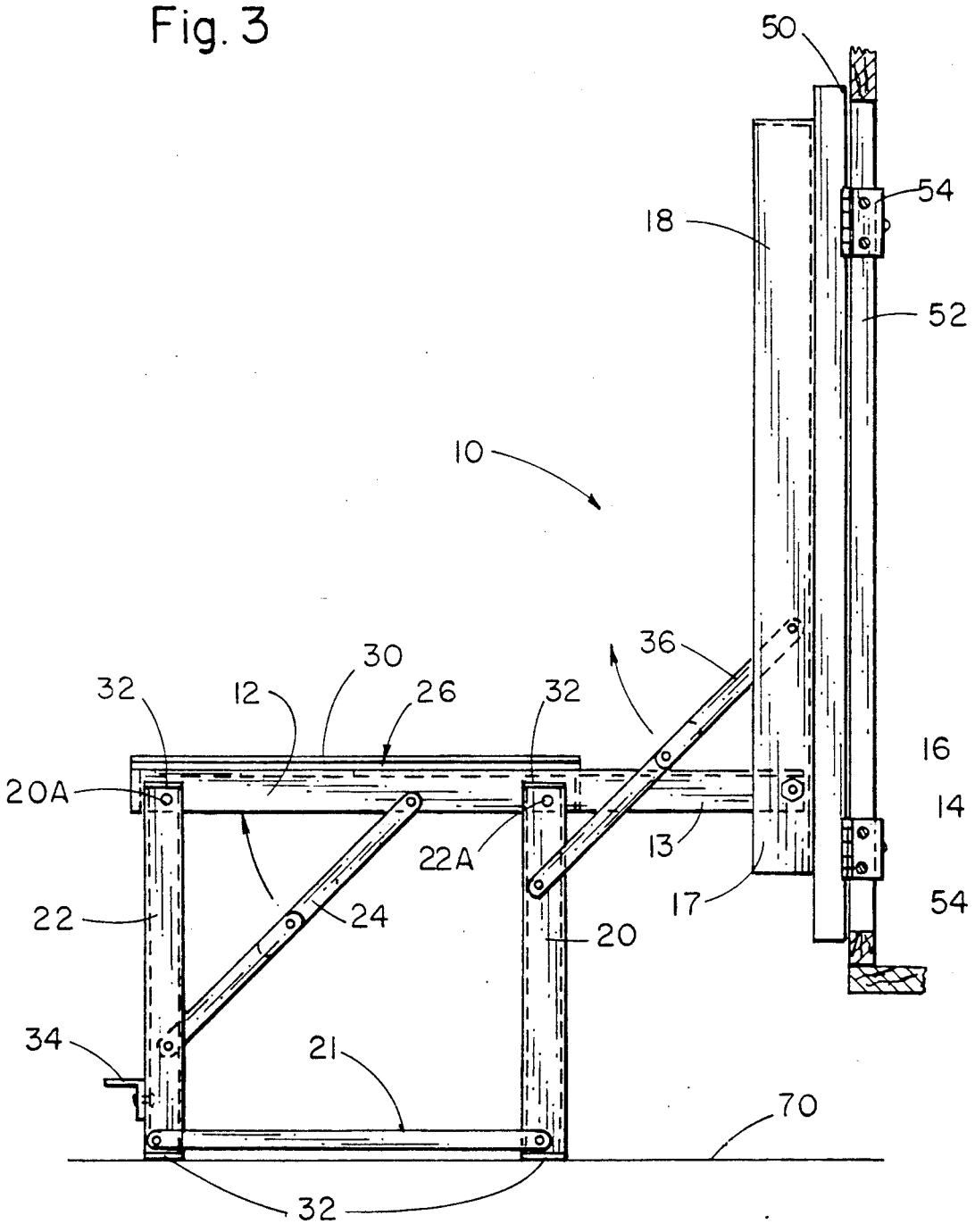
Figure 4:
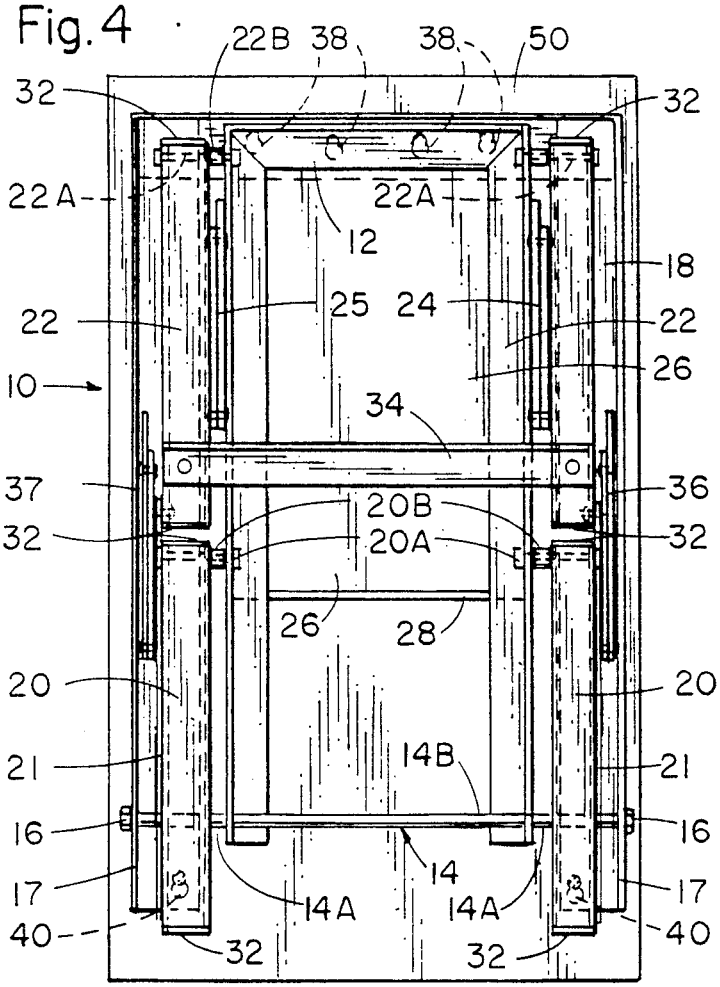
Figure 5:
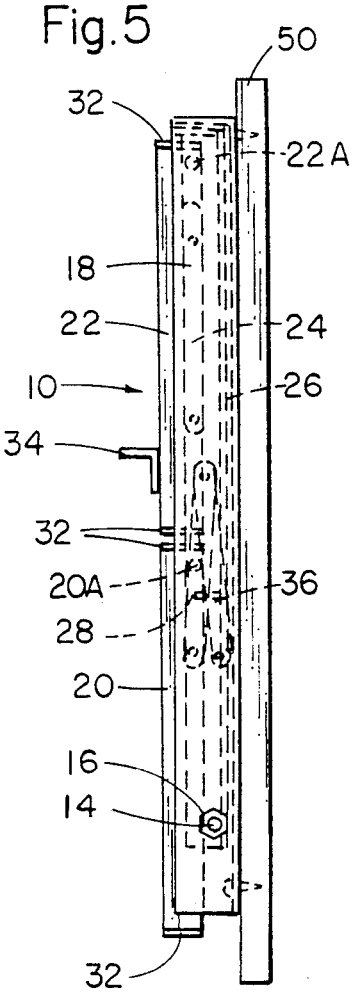

Referring now specifically to FIGS. 2, 3, 4, and 5, the overall invention is referenced by the numeral 10, with arrow, and said invention being comprised of an inverted U-shaped platform support member 12, which is fabricated out of angled material. At the distal ends 13 of the member 12, there is an axle 14, made of continuously threaded rod, which is co-axially mounted within an outer inverted U-shaped member 18, said member 18 being fabricated of angled material, and which is the mounting bracket of the device. Snugly fitting tubular spaces 14A keep the support member 12 centrally located within the bracket 18, while another tubular spacer 14B located within the angled member 12 provides a stiffening effect to preclude inward deflection of the ends 13, thus keeping the two member 12 and 18 at a properly spaced relationship at all times. Self locking nuts 16 secures the aforementioned assembly in a relatively rigid, yet pivotal configuration.

The U-shaped support member 12 for the platform plate 26 is, itself, supported by two pairs (in this preferred embodiment) of parallel swinging legs 20 and 22 which are pivotally attached by means of fasteners 20A and 22A and are spaced apart from the member 12 by tubular spacers 20B and 22B respectively. The legs 20 and 22 are maintained in a parallel swinging mode by means of connecting bars 21, pivotally fitted to the outer surfaces of the legs 20 and 22. There are also a pair of foldable locking brackets 24 and 25 (well-known to those practiced in this art), which lock the legs 22 in a 90° angled relationship to the support member 12. Through the connecting bars or rods 21, all four legs 20 and 22 are maintained at a 90° disposition to member 12 when brackets 24 and 25 are locked. An angle bracket 34, attached to the front face portions of legs 22 provided a rigid connection between them to ensure that all four legs move in unison. Bracket 34 could be round, channel, rectangular or a recessed angle in cross-section, but in this preferred embodiment, the angle seems to be the most economical shape to ensure functional rigidity to this portion of the device.

The platform plate 26 has a 90° braked lip 28 lying between the legs 13 of the member 12. The lip 28 provides structural rigidity to the plate 26, which is, in fact, the platform of the step-stool. An optional rubber or plastic tread 30 may be cemented to the top of the plate 26, or, the top surface of the plate 26 could be striated or otherwise provided with a non-slip surface integral with the plate, itself.

In this preferred embodiment, all four of the legs 20 and 22 are fabricated from square tubing material. Other cross-sectional shapes could be used, but due to the geometric collapsibility of this device, offset locations of pivotal holes in the various members dictate a preference for square or rectangular cross-sectional members. All four legs have plastic insert plugs 32 at their tops and bottoms to provide non-marring feet at the bottoms and a more finished aesthetic appearance to the tops.

Another pair of foldable locking brackets 36 and 37, similar to brackets 24 and 25 interface with the rear legs 20 and the vertical portions 17 of the bracket 18. In a permanently mounted configuration, thse would not be needed; however, since this is a demountable device, these brackets, 36 and 37, when locked, maintain the bracket 18 in a rigid vertical relationship to the stool, enabling the user to more easily handle and carry the device from place to place with minimal stooping over when relocating the stool.

The mounting bracket 18 has a plurality of keyhole shaped mounting holes 38 near the top, with lower keyhole shaped holes 40, strategically located along the legs 17 provided a detachable means of mounting the bracket 18 to a door or other planar surface. By utilizing these inverted keyhole hole without firm tightening of the mounting screws (not shown), the bracket may be slipped downwardly onto the screws into the narrowed slots. This slip-mounting method of attaching the bracket provides easy demountability from the cabinet door or other planar surface to which the device may be stored.

Figure 6:
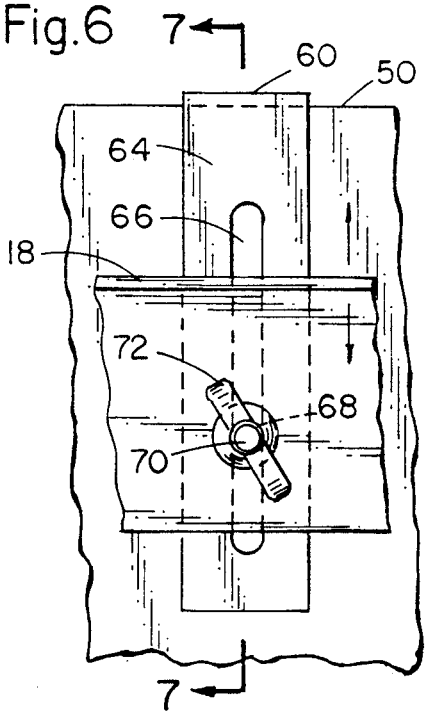
Figure 7:
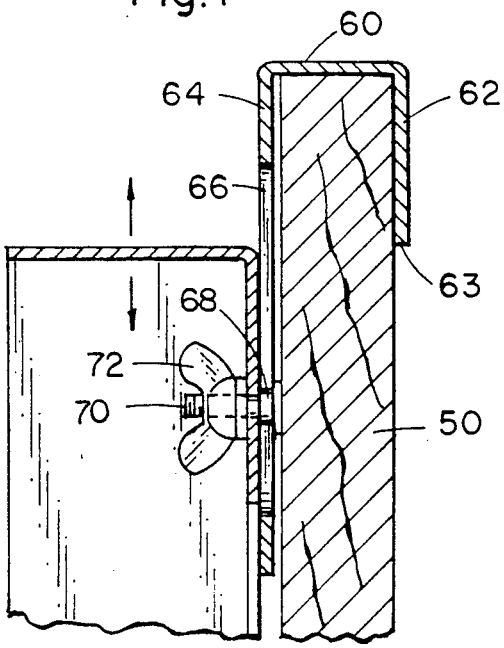

Thus, it can be readily understood that by leaving the mounting screws somewhat loose, the device is detachable, while tightening the screws make for a more permanent type of installation. Shown in FIGS. 6 and 7 is an alternate method of detachable mounting, without the need for tools. This method consists of a pair of inverted flat U-shaped brackets 60, having a downwardly disposed leg 62, flared outwardly as at 63, plus a longer downwardly disposed leg 64 with a continuous slot 66 through which a flat headed bolt 70 with a square shank 68 can slide. A wing-out or finger-nut 72 tightens the bracket 60 to the desired adjustment. This gives the user the option of tool-less installation of the stool to a cabinet door; however, aesthetically, it may not be appealing to most users since the legs 62 would be visible outside the closed door. Nevertheless, in a workshop environment, this might not be objectionable, and is an optional part of this invention.

Referring now to FIG. 1, in this perspective view of the invention, the solid lines depict the invention mounted to a cabinet door with the door swung open to 180°, providing accessibility to one or more wall cabinets to the left and above the base cabinet door shown. In phantom lines, the door is shown at a 90° swing, providing accessibility to one or more wall cabinets to the right and above. In all views where depicted, the door is referenced by the numeral 50, cabinet frame and face 52, offset hinges 54, countertop 58, drawers 56 and floor 70.

From the foregoing detailed description, it should be readily understood that certain substitutions, variations and the like may be resorted to without departing from the spirit, scope or intent of the claims which follow.

What is claimed is:

1. A collapsible folding step-stool which is mountable to a recipient surface, comprising:

a bracket mountable to the recipient surface;

a platform movable between a lowered, generally horizontal, operative position and a raised, generally vertical, inoperative position;

a pair of parallel arms attached at their first ends to the platform and pivotally coupled at their second ends to the bracket; and four parallel support legs, each pivotally movable between a lowered generally vertical operative position laterally offset from the bracket and perpendicular to the platform and a raised generally vertical inoperative position parallel with the platform, the support legs all having upper ends pivotally coupled to the platform for arcuate movement therewith.

2. The apparatus as set forth in claim 1 and further including means interfacing the legs whereby the legs pivot in unison.

3. The apparatus as set forth in claim 1 and further including means coupling the legs and the bracket to maintain the platform locked when in the horizontal operative position.

4. The apparatus as set forth in claim 1 and further including means to detachably secure the bracket to the recipient surface.

5. The apparatus as set forth in claim 1 wherein the legs have lower ends which, when the platform is in the horizontal operative position, are adapted to rest on the floor with the lower ends of the legs at a lower elevation than the bottom of the bracket.

6. The apparatus as set forth in claim 1 and further including a cabinet door which constitutes the recipient surface.

7. A collapsible folding step-stool in combination wtih a cabinet door, comprising:

a bracket mountable to the cabinet door;

a platform movable between a lowered, generally horizontal, operative position and a raised, generally vertical, inoperative position;

pair of parallel arms attached at their first ends to the platform and pivotally coupled at their second ends to the bracket;

four parallel support legs, each pivotally movable between a lowered generally vertical operative position laterally offset from the brackets and perpendicular to the platform and a raised generally vertical inoperative position parallel with the platform, the support legs, all having upper ends pivotally coupled to the platform for arcuate movement therewith, the legs have lower ends which, when the platform is in the operative position, are adapted to rest on the floor with the lower ends of the legs at a lower elevation than the bottom of the bracket and cabinet door;

means interfacing the legs whereby the legs pivot in unison;

means coupling the legs and the bracket to maintain the platform locked when in the horizontal operative position; and means to detachably secure the bracket to the cabinet door.

* * * * *